US006149009A

United States Patent [19]

DeNola

[11] Patent Number: 6,149,009

[45] Date of Patent: Nov. 21, 2000

[54] SHIPPING CONTAINER HAVING A V-PACK INSERT

[76] Inventor: Robert C. DeNola, 1552 Montague Expressway, San Jose, Calif. 95131

[21] Appl. No.: 09/303,273

[22] Filed: Apr. 30, 1999

Related U.S. Application Data

[60] Provisional application No. 60/083,642, Apr. 30, 1998.

[51] Int. Cl.[7] ..... B65D 81/02

[52] U.S. Cl. ..... 206/586; 206/453; 206/587

[58] Field of Search ..... 206/453, 523, 206/586, 587, 588

[56] References Cited

U.S. PATENT DOCUMENTS

| | | | |
|---|---|---|---|
| 1,720,889 | 7/1929 | Eshleman . | |
| 2,755,982 | 7/1956 | Lugt, Jr. | 229/19 |
| 2,863,595 | 12/1958 | Emery | 229/2.5 |
| 2,970,739 | 2/1961 | Levkoff | 229/31 |
| 3,572,574 | 3/1971 | Mears | 229/14 |
| 3,653,496 | 4/1972 | Roberts et al. | 206/46 |
| 3,692,264 | 9/1972 | Burkhard et al. | 248/15 |
| 3,720,366 | 3/1973 | Martin | 229/37 E |
| 4,317,517 | 3/1982 | Tisdale | 206/597 |
| 4,606,460 | 8/1986 | Luray | 206/583 |
| 4,759,446 | 7/1988 | Dobashi et al. | 206/586 |
| 5,259,507 | 11/1993 | Smith | 206/583 |
| 5,287,968 | 2/1994 | Ridgeway | 206/583 |

FOREIGN PATENT DOCUMENTS 4-367466A 12/1992 Japan .

OTHER PUBLICATIONS

PCT International Application No. US99/09447, Notification of the Transmittal of the International Search Report or the Declaration.

*Primary Examiner*—David T. Fidei
*Attorney, Agent, or Firm*—Thompson Hine & Flory LLP

[57] ABSTRACT

A carton for shipping fragile wares comprising a regular slotted container and an insert for suspending the wares between the top, bottom and side panels of the regular slotted container. The insert is characterized in that it includes upwardly and downwardly sloping sidewalls which meet at a vertex to form a "v" shape. The fragile wares are placed on the downwardly sloping sidewalls of the insert and the top of the container is closed, thereby clamping the fragile wares away from the sides, top, and bottom of the container. This suspension construction protects the wares from outside shocks and forces during shipping. Preferably, the insert of the present invention is formed from two symmetric "C" shaped pieces and is made of corrugated cardboard.

16 Claims, 4 Drawing Sheets

SHIPPING CONTAINER HAVING A V-PACK INSERT

CROSS REFERENCE TO RELATED APPLICATIONS

This application claims priority from provisional application U.S. Ser. No. 60/083,642 entitled "Shipping Container having a V-Pack Insert," filed on Apr. 30, 1998.

BACKGROUND OF THE INVENTION

This invention relates to a shipping container for fragile equipment, such as computer boards, laptop computers, consumer electronics, medical and laboratory devices, etc. The shipping container of the invention may be made of any suitable materials, however corrgated paperboard has been found to be especially preferred. More particularly, the present invention relates to a novel suspension system for a network hub or other electronic device which is designed to fit into a regular slotted container.

In the past there have been many shipping containers utilized for transporting fragile items. However, while many of these prior packaging arrangements have advantages, none has been able to effectively combine the attributes of low production costs, simple design, and overall product protection to produce a shipping container meeting the stringent needs of the computer industry. Accordingly, it would be desirable to have a packaging system meeting these needs that may be easily and inexpensively produced using preexisting materials and processing equipment. It is further desired to have a packaging insert that fits into a standard regular slotted container, which is easy to load for ready shipment, optimally protects the loaded equipment from G-force shock, and may be produced in one or many different pieces. Additionally, while it is preferred that the shipping container be an insert sized to fit in a regular slotted container, it is considered within the scope of the present invention to have a shipping container embodying the present invention that is a unitary design and which would not require the secondary outer shell.

SUMMARY OF THE INVENTION

In accordance with the present invention, a shipping container is provided for fragile wares. More particularly, the invention provides an V-pack suspension insert for a regular slotted container (RSC) that provides support and protection for a computer board such as a network hub, that allows easy insertion of the product into the container from the top, that is of simple design and is easy to fabricate, and can be produced in one or more pieces.

The shipping container of the present invention includes an RSC and a V-pack suspension insert which may be produced in one or more pieces. In a preferred embodiment, the suspension insert is made of two pieces. The V-pack suspension insert is assembled after die cutting by being run through a folder-gluer. The top and bottom panels are then bent to form a "V" shaped channel. The channel is formed in such a way that it may be bent around corners so that the insert may more easily fit into the RSC. The V-pack insert contains an optional lock that assists in holding the insert during folding. Once the insert is inserted into the RSC the product, such as a network hub, is loaded into the container. The hub engages the lower downward sloping "V" shaped sidewall of the insert thereby suspending the hub above the bottom and away from the sides of the RSC. The top of the RSC can then be closed, forcing the upper upward sloping "V" shaped sidewall down on the hub, thus clamping the hub in a centered position away from all of the walls of the RSC. The V-pack suspension insert contains features that may be adjusted to vary the rigidity/flexibility of the packaging depending on the particular product to be shipped or requirements that need to be met. Included in these features are footings and braces which may be die-cut into the V-pack suspension insert during production. The size of these options may be varied to change the flexibility of the packaging depending on the product requirements.

DETAILED DESCRIPTION

Figure 1:
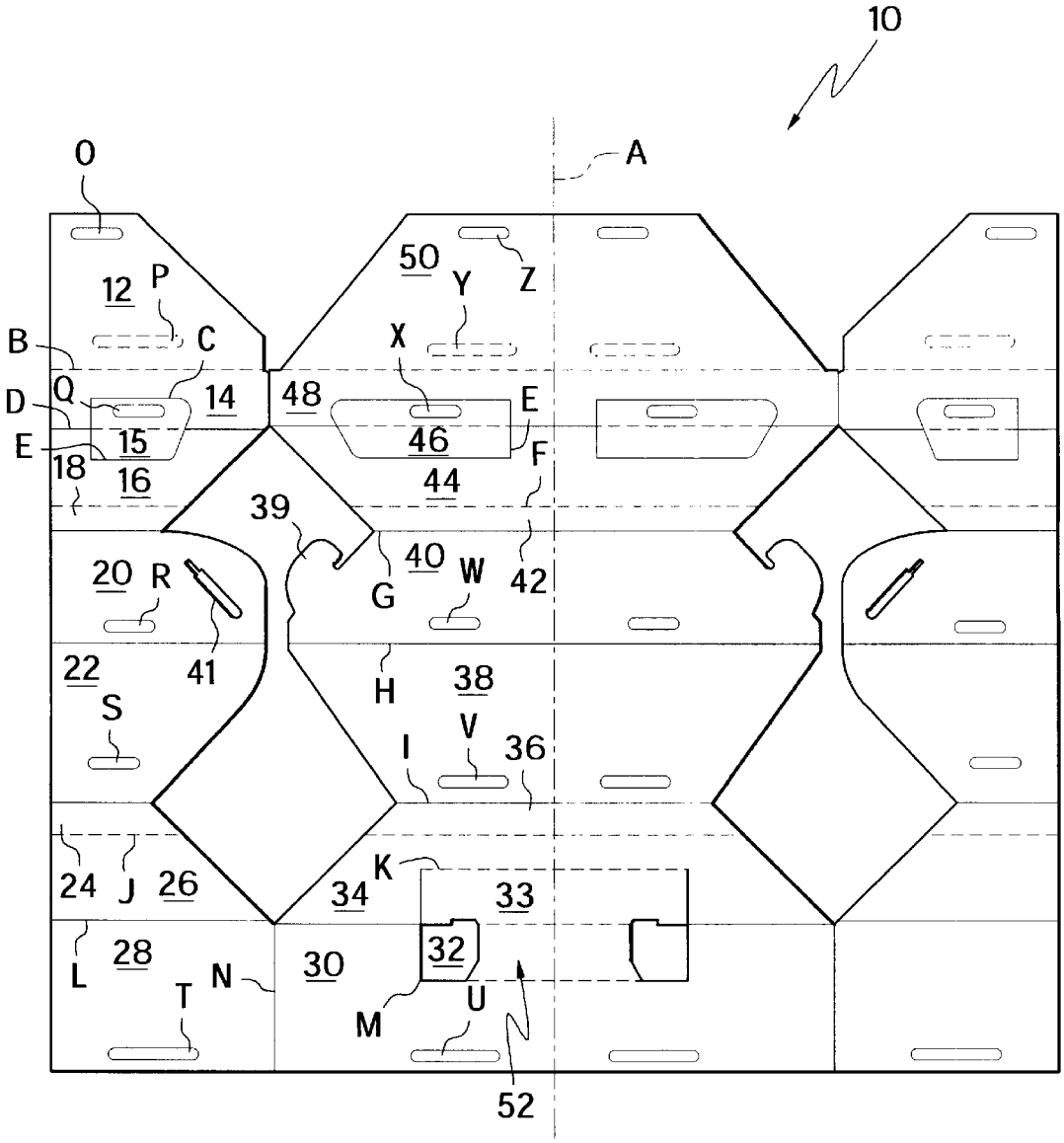
FIG. 1 is an overhead plan view of one die-cut piece of one half of an unfolded, unglued V-pack suspension insert of the present invention.

Referring first to FIG. 1, one half of a V-pack insert 10 of the present invention is shown after having been die cut. The single half piece of the V-pack insert 10 is symmetrical about a central axis A, and therefore all discussion will be directed to the left side of the insert, as shown in FIG. 1, but applies equally to the right side of the insert 10 as well. The dotted lines represent perforations in the die cut insert. The thin solid lines represent fold lines and the thick solid lines indicate cut lines. The oblong areas on the unfolded insert 10 (designated by letters O–Z) represent areas where glue is applied to attach individual folded panels of the insert together.

As shown in FIG. 1, a single piece of a two piece embodiment of a V-pack insert 10 is assembled as follows. First flap 15 is folded along line E and glue area Q is glued to area R on panel 20. Simultaneously, flap 46 is folded along line E and glue area X is glued to area W on panel 40. Flaps 15 and 46 thus folded and glued create spacer elements between the front and back portions of the insert 10 when it is folded over upon itself and the flaps 15, 46 are folded inwardly along perforation D. The flaps 15, 46 perform a dual purpose in also acting to absorb some shocks that may be sustained by the container from outside forces.

Figure 5:
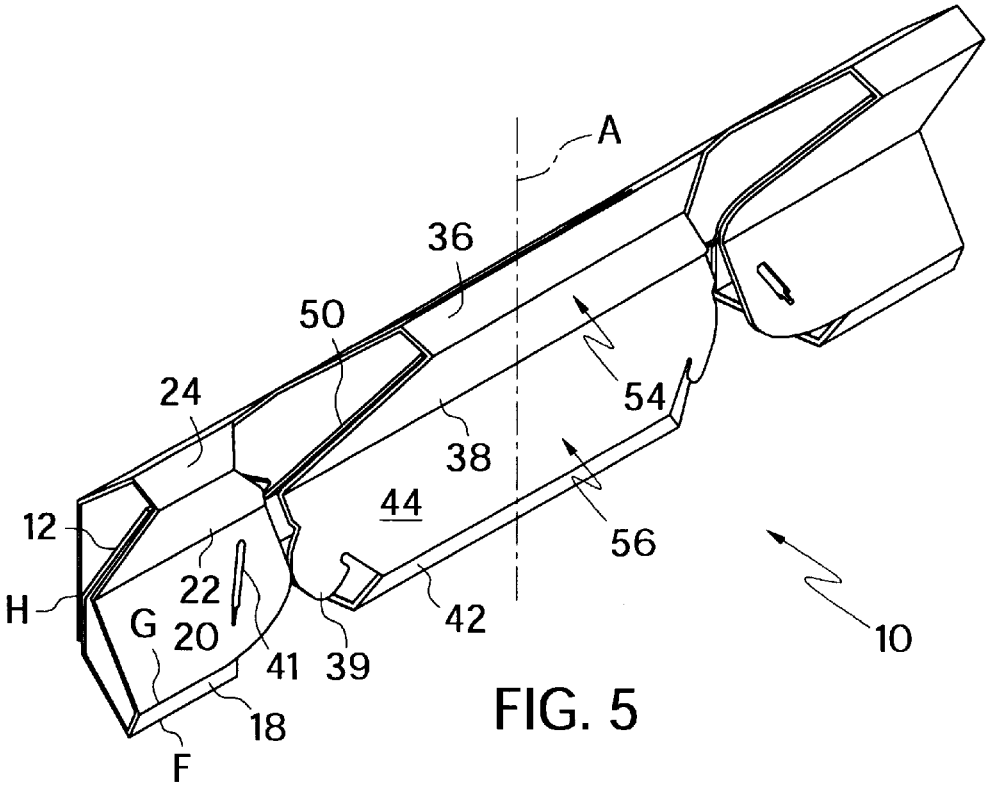
FIG. 5 is a front perspective view of the assembled glued V-pack insert of FIG. 1 prior to folding the corners in to fit inside an RSC.
Figure 6:
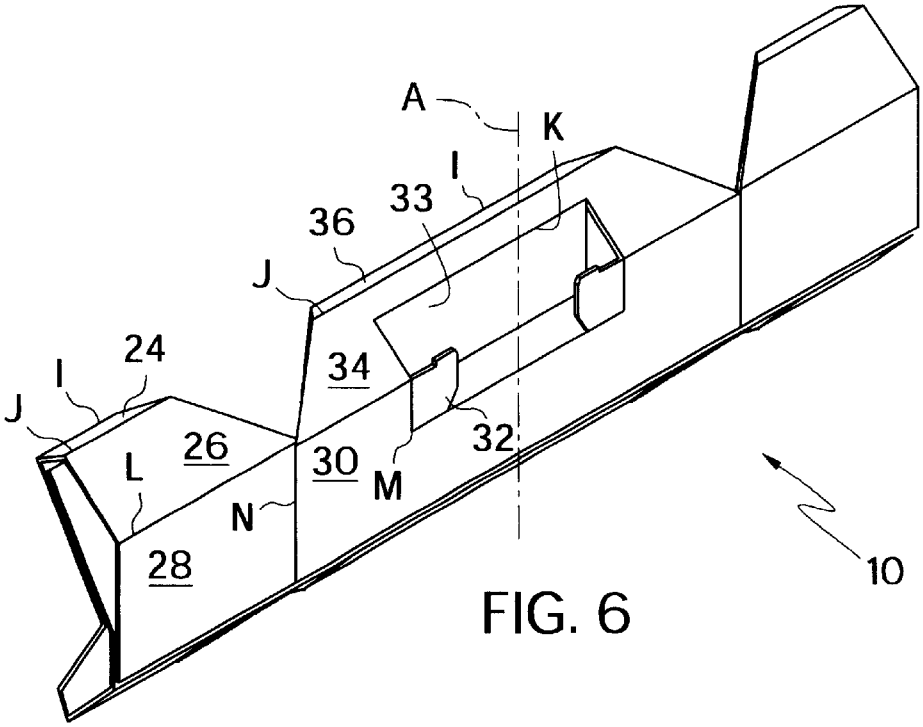
FIG. 6 is a rear perspective view of the V-pack insert of FIG. 5.

Next, flap 12 is then folded along perforation B and glue area O is glued to area S on panel 22. Likewise, flap 50 is folded along perforation B and glue area Z is glued to area V on panel 38. The last gluing procedure involves folding flaps 28 and 30 along perforation J and gluing areas T and U to gluing areas P and Y shown in phantom on the back of flaps 12 and 50. During this procedure panel 33 is pushed inwardly along perforations M, L, and K, thus producing a shock absorbing element 52 in the back of the insert. The overlap of panels 48 and 30 and 14 and 28 that is created by this gluing adds strength to the insert 10, especially at fold line N. In this manner a flat V-pack insert 10 as shown in FIGS. 5 and 6 is created.

Figure 2:
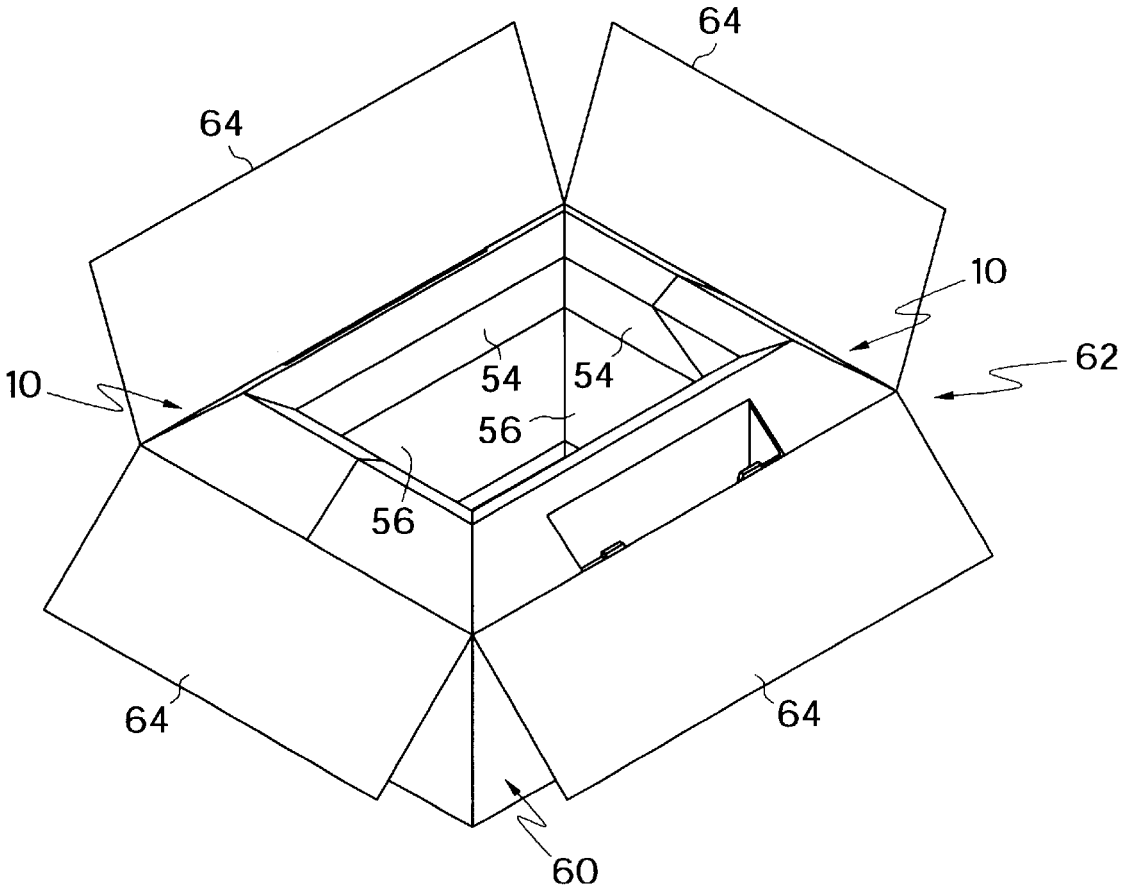
FIG. 2 is a top perspective view of the assembled shipping container of the present invention including both halves of the V-pack insert and the regular slotted container.
Figure 3:
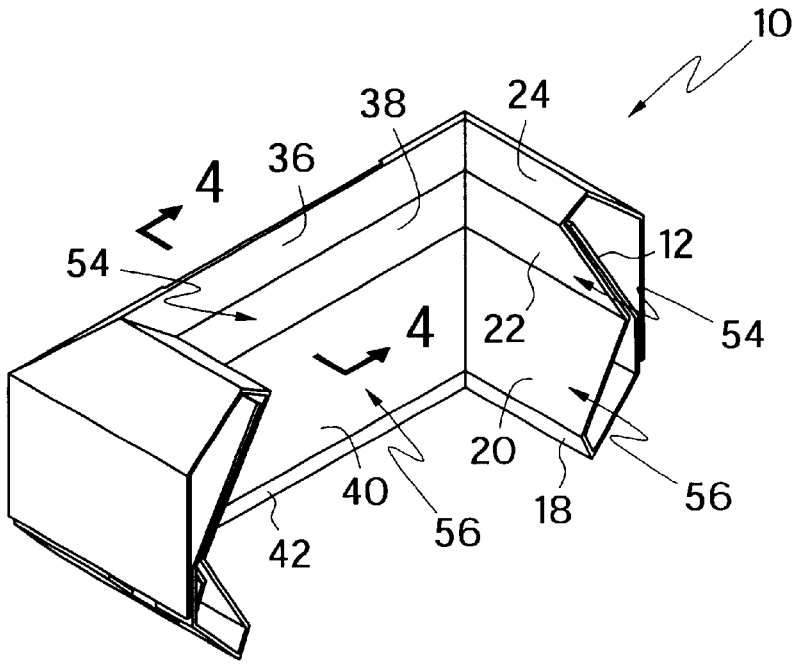
FIG. 3 is a side perspective view of the assembled glued V-pack insert of FIG. 1.
Figure 4:
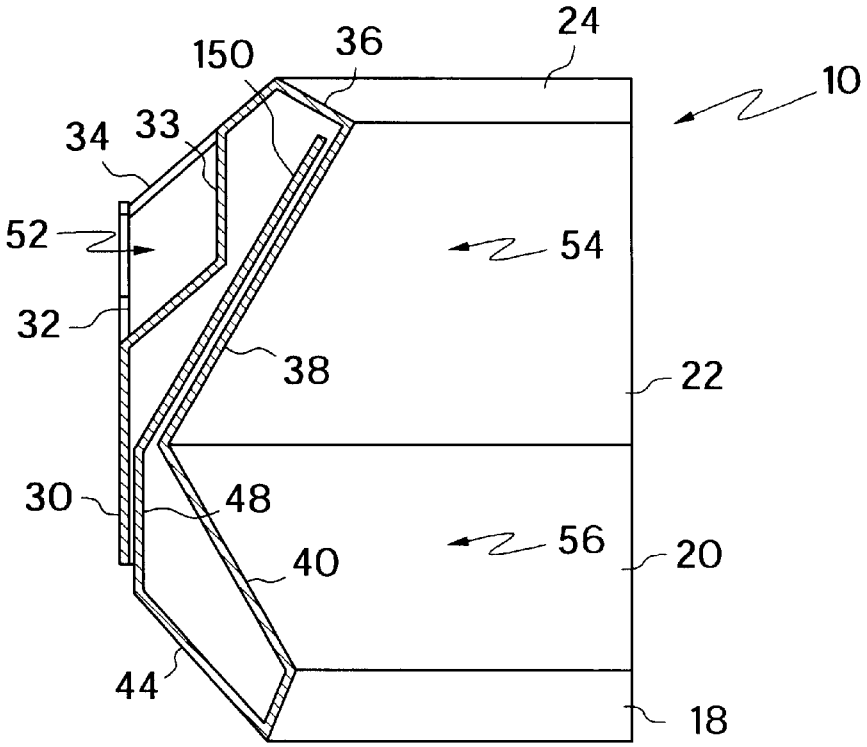
FIG. 4 is a side elevational view of the assembled glued piece of the V-pack insert of FIG. 3 taken along line 4—4.

Next, by inserting tab 39 into slot 41 and folding along line N, the sides of the insert can be brought in at a 90 degree angle to create the V-pack insert 10 as shown in FIG. 3. The insert 10 is characterized by maintaining a rough "V" shape, with upwardly and downwardly sloping sidewalls 54, 56. Finally, by adding another substantially similar piece, a generally rectangular insert can be formed. By adding this rectangular form to an appropriately shaped regular slotted container 60, a shipping container 62 ready for insertion of fragile ware, as shown in FIG. 2, is created. The ware, preferably a network hub or computer board (not shown), can then be placed on the downwardly 56 sloping sidewalls of the V-pack suspension insert and the top flaps of the RSC 60 can be closed and secured over it. The securing of the top flaps 64 of the RSC 60 compresses the upwardly sloping sidewalls 54 of the V-pack insert 10 downwardly over the hub, thereby clamping and centering the hub between the upwardly and downwardly sloping sidewalls 54, 56 of the insert 10.

Although the construction herein described is a preferred method for creating a "V" shaped insert for shipping fragile wares, those skilled in the art will appreciate that other methods would be effective and are considered within the scope of the invention.

While the form of the apparatus herein described constitutes a preferred embodiment of the invention, it is to be understood that the invention is not limited to this precise form of apparatus, and that changes may be made therein without departing from the scope of the invention.

What is claimed is:

1. A carton for shipping fragile wares comprising:

a container including a bottom panel, side panels, an upper opening, and a top panel shaped to cover said upper opening, wherein said container is shaped to receive at least one cushioning insert, at least one cushioning insert having a back segment faced outwardly of said container and shaped to abut a side panel of said container and a front segment faced inwardly of said container including upwardly and downwardly sloping sidewalls, said sidewalls meeting at a vertex to form a "v", and wherein said upwardly sloping sidewalls are biased to protrude above a top of said container;

wherein said upwardly sloping sidewalls are connected to a top section which is shaped to engage said top panel of said container and said downwardly sloping sidewalls are connected to a base section which is shaped to engage said bottom panel of said container, such that a fragile ware is clamped between said upwardly and downwardly sloping sidewalls when said top panel is closed upon said upper opening compressing said upwardly sloping sidewalls into said container and thereby suspending said fragile ware between said top, bottom, and side panels of said container when said fragile ware is placed in said container and said top panel is secured over said insert.

2. The carton of claim 1 wherein said top panel and said bottom panel of said container are comprised of flaps extending from each of said side panels.

3. The carton of claim 1 wherein said container is a regular slotted container.

4. The carton of claim 1 wherein said cushioning insert is comprised of two symmetrical components.

5. The carton of claim 4 wherein each of said components of said cushioning insert is formed from a single die-cut blank.

6. The carton of claim 1 wherein said insert and said container are composed of corrugated paperboard.

7. The carton of claim 1 wherein said insert and said container are composed of folding carton material.

8. The carton of claim 1 wherein said insert and said container are composed solid fiber material.

9. The carton of claim 1 wherein the dimensions and characteristics of said insert can be altered to meet specific shipping requirements.

10. The carton of claim 9 wherein said alteration includes changing the material properties.

11. The carton of claim 9 wherein said alteration includes changing the type of material used.

12. The carton of claim 9 wherein said alteration includes changing the flute.

13. The carton of claim 9 wherein said alteration includes changing the liner combinations.

14. The carton of claim 9 wherein said alteration includes changing the bracing features.

15. The carton of claim 9 wherein said alteration includes changing the overlapping features.

16. The carton of claim 9 wherein said alteration includes changing the geometry of said insert.

* * * * *